US011821225B1

(12) United States Patent
Smith

(10) Patent No.: US 11,821,225 B1
(45) Date of Patent: Nov. 21, 2023

(54) SAND-FILLED UMBRELLA HOLDER WITH TABLETOP

(71) Applicant: Anthony Smith, Elkridge, MD (US)

(72) Inventor: Anthony Smith, Elkridge, MD (US)

( * ) Notice: Subject to any disclaimer, the term of this patent is extended or adjusted under 35 U.S.C. 154(b) by 253 days.

(21) Appl. No.: 17/462,079

(22) Filed: Aug. 31, 2021

(51) Int. Cl.
*E04H 12/22* (2006.01)
*A47B 37/04* (2006.01)
*A45B 23/00* (2006.01)

(52) U.S. Cl.
CPC ..... *E04H 12/2246* (2013.01); *A45B 23/00* (2013.01); *A47B 37/04* (2013.01); *A45B 2023/0012* (2013.01); *A45B 2200/1063* (2013.01)

(58) Field of Classification Search
CPC ..... A47B 37/04; A47B 2003/004; A47B 3/06; E04H 12/2246; A45B 2023/0012; A45B 2200/1063; A45B 23/00
See application file for complete search history.

(56) References Cited

U.S. PATENT DOCUMENTS 2,799,543 A * 7/1957 Tomaselli ..... A45B 23/00 D3/10
4,296,693 A * 10/1981 Archer ..... E04H 12/2246 248/910
4,832,163 A * 5/1989 Levesque ..... A45B 3/00 108/14
5,143,108 A * 9/1992 Kenney ..... A45B 23/00 108/151
5,452,877 A * 9/1995 Riffle ..... E04H 12/2246 135/902
6,446,649 B1 * 9/2002 Bigford ..... E04H 12/2246 135/25.1
6,487,977 B1 12/2002 Williams
6,554,149 B2 * 4/2003 Schneider ..... D06F 95/002 220/666
6,895,982 B1 * 5/2005 Shaw ..... E04H 12/2246 135/16
8,047,217 B1 * 11/2011 Schermerhorn, Jr. ..... E04H 12/2215 248/910
8,783,274 B1 * 7/2014 Supino ..... A45F 3/44 248/529
9,101,206 B1 8/2015 Chen
9,974,369 B1 * 5/2018 DePaolo ..... E04H 12/2246
10,925,363 B1 * 2/2021 Schermerhorn ..... A45B 23/00
11,213,023 B2 * 1/2022 Cao ..... A01M 1/2055
11,612,241 B2 * 3/2023 Schneiderman ..... A45B 23/00 108/50.12
2002/0036008 A1 * 3/2002 Hickam ..... E04H 12/2246 248/188.7

(Continued)

*Primary Examiner* — Daniel J Rohrhoff
(74) *Attorney, Agent, or Firm* — Kyle A. Fletcher, Esq.

(57) ABSTRACT

The sand-filled umbrella holder with tabletop comprises a base, a table top, and an umbrella. When deployed, the base may be operable to hold the umbrella in an upright position and may be operable to support the table top above the ground. The base may be deployed by filling the base with a filler material to give weight and form to the base. As non-limiting examples, the filler material may comprise sand, dirt, or water. The base may collapse when not deployed for easier transportation and storage. The umbrella may provide shade when open for use. The umbrella may close for easier transportation and storage when not in use.

19 Claims, 5 Drawing Sheets

(56) References Cited

U.S. PATENT DOCUMENTS

| | | | | |
|---|---|---|---|---|
| 2010/0163086 | A1* | 7/2010 | Chavez | A47B 37/04 135/16 |
| 2015/0090307 | A1* | 4/2015 | Supino | E04H 12/2246 135/15.1 |
| 2015/0159394 | A1 | 6/2015 | Oliveira | |
| 2015/0320161 | A1* | 11/2015 | Perry | E04H 12/2246 248/533 |
| 2016/0192748 | A1 | 7/2016 | McQuaid | |
| 2022/0186514 | A1* | 6/2022 | Conlon | E04H 12/2246 |
| 2023/0064396 | A1* | 3/2023 | Foley | A47B 37/04 |

* cited by examiner

SAND-FILLED UMBRELLA HOLDER WITH TABLETOP

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the fields of beach accessories and portable furniture, more specifically, a sand-filled umbrella holder with tabletop.

SUMMARY OF INVENTION

The sand-filled umbrella holder with tabletop comprises a base, a table top, and an umbrella. When deployed, the base may be operable to hold the umbrella in an upright position and may be operable to support the table top above the ground. The base may be deployed by filling the base with a filler material to give weight and form to the base. As non-limiting examples, the filler material may comprise sand, dirt, or water. The base may collapse when not deployed for easier transportation and storage. The umbrella may provide shade when open for use. The umbrella may close for easier transportation and storage when not in use.

An object of the invention is to provide an umbrella to provide protection from the sun and/or rain.

Another object of the invention is to provide a table top elevated above the ground and surrounding the umbrella pole.

A further object of the invention is to provide a collapsible made to support the table top and to retain the umbrella in an upright orientation.

Yet another object of the invention is to provide a base that may be collapsed for storage and transportation when not deployed and may be filled with a filler material to deploy.

These together with additional objects, features and advantages of the sand-filled umbrella holder with tabletop will be readily apparent to those of ordinary skill in the art upon reading the following detailed description of the presently preferred, but nonetheless illustrative, embodiments when taken in conjunction with the accompanying drawings.

In this respect, before explaining the current embodiments of the sand-filled umbrella holder with tabletop in detail, it is to be understood that the sand-filled umbrella holder with tabletop is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the sand-filled umbrella holder with tabletop.

It is therefore important that the claims be regarded as including such equivalent construction insofar as they do not depart from the spirit and scope of the sand-filled umbrella holder with tabletop. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
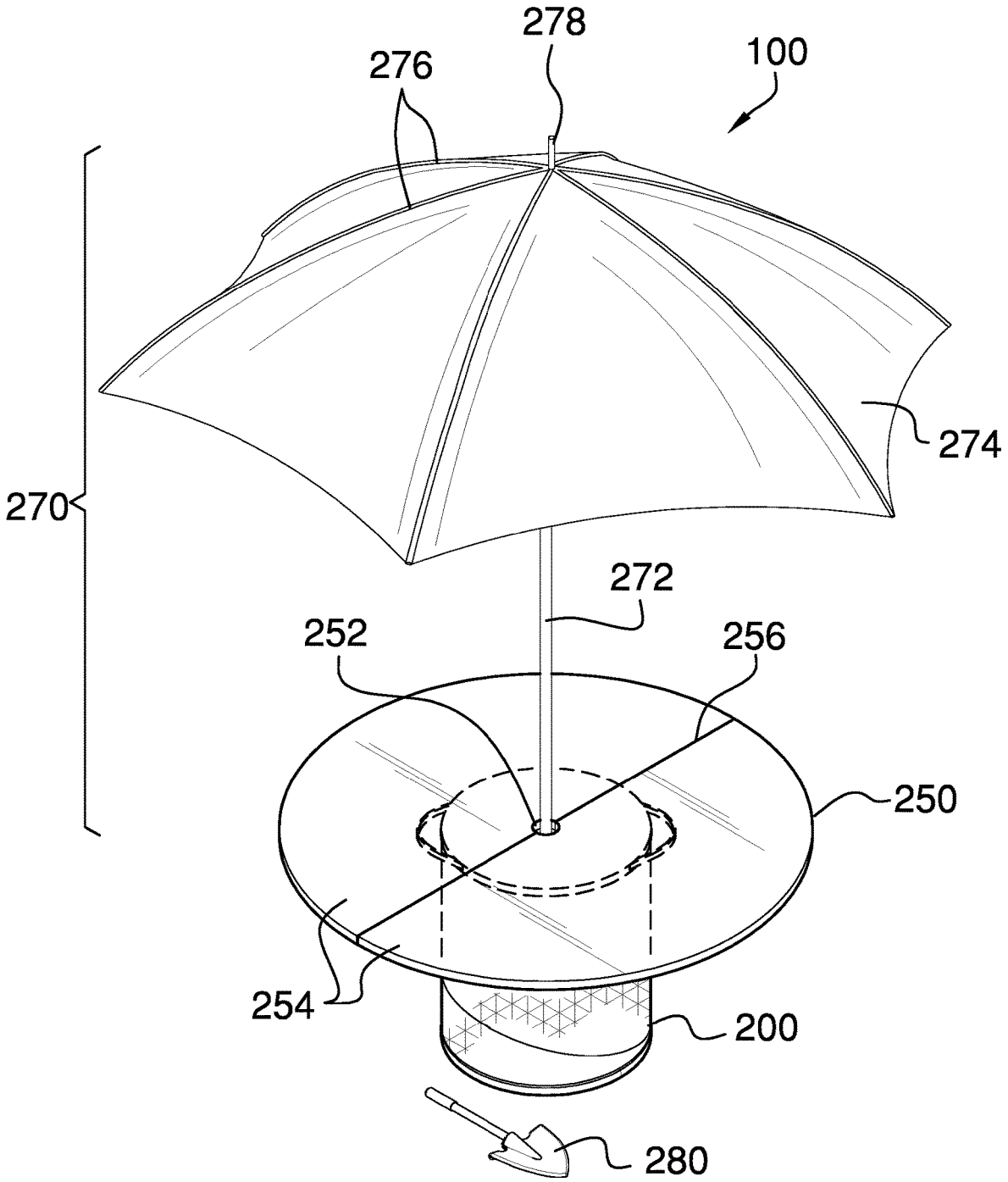
FIG. 1 is an isometric in-use view of an embodiment of the disclosure.
Figure 2:
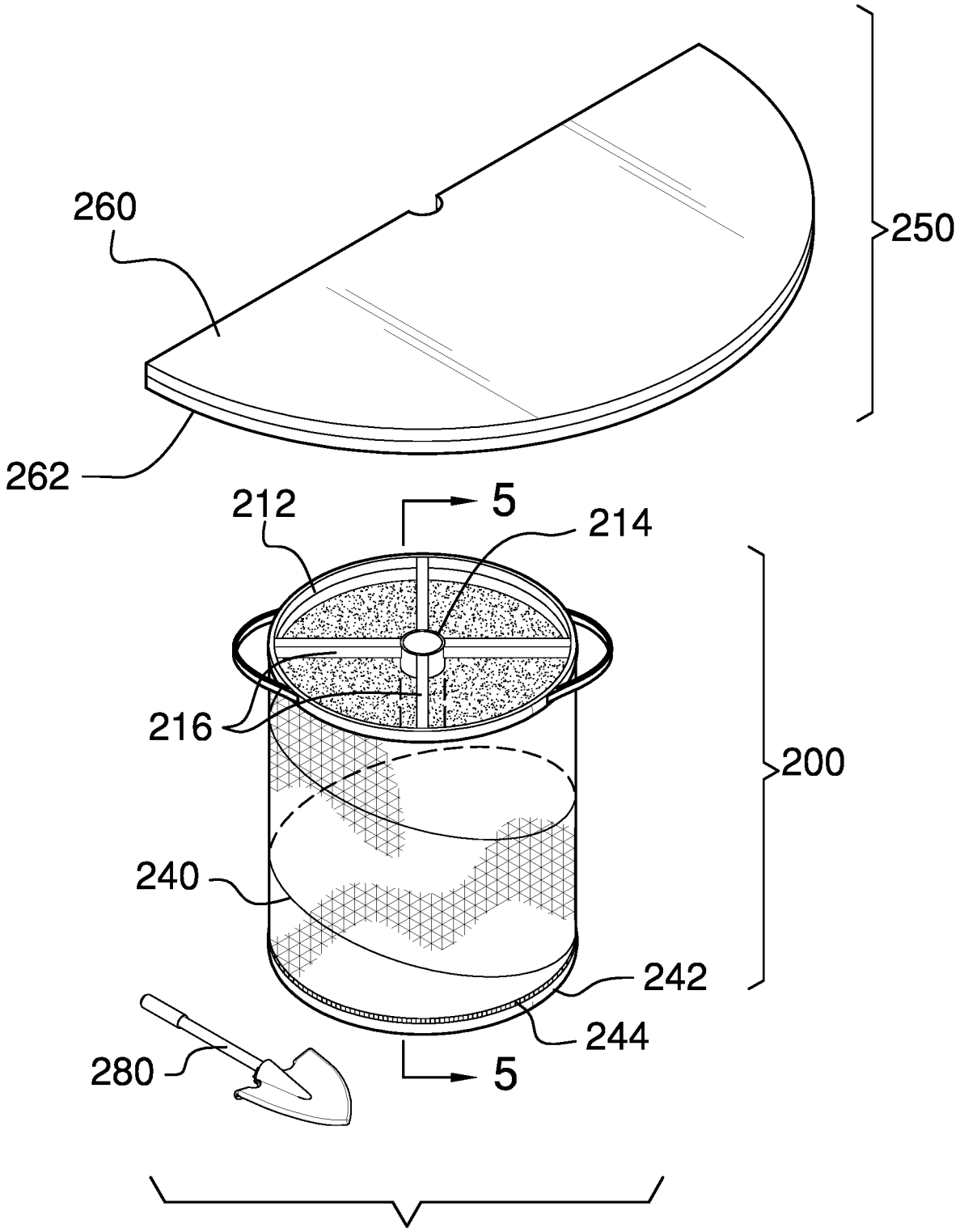
FIG. 2 is an exploded view of an embodiment of the disclosure.
Figure 3:
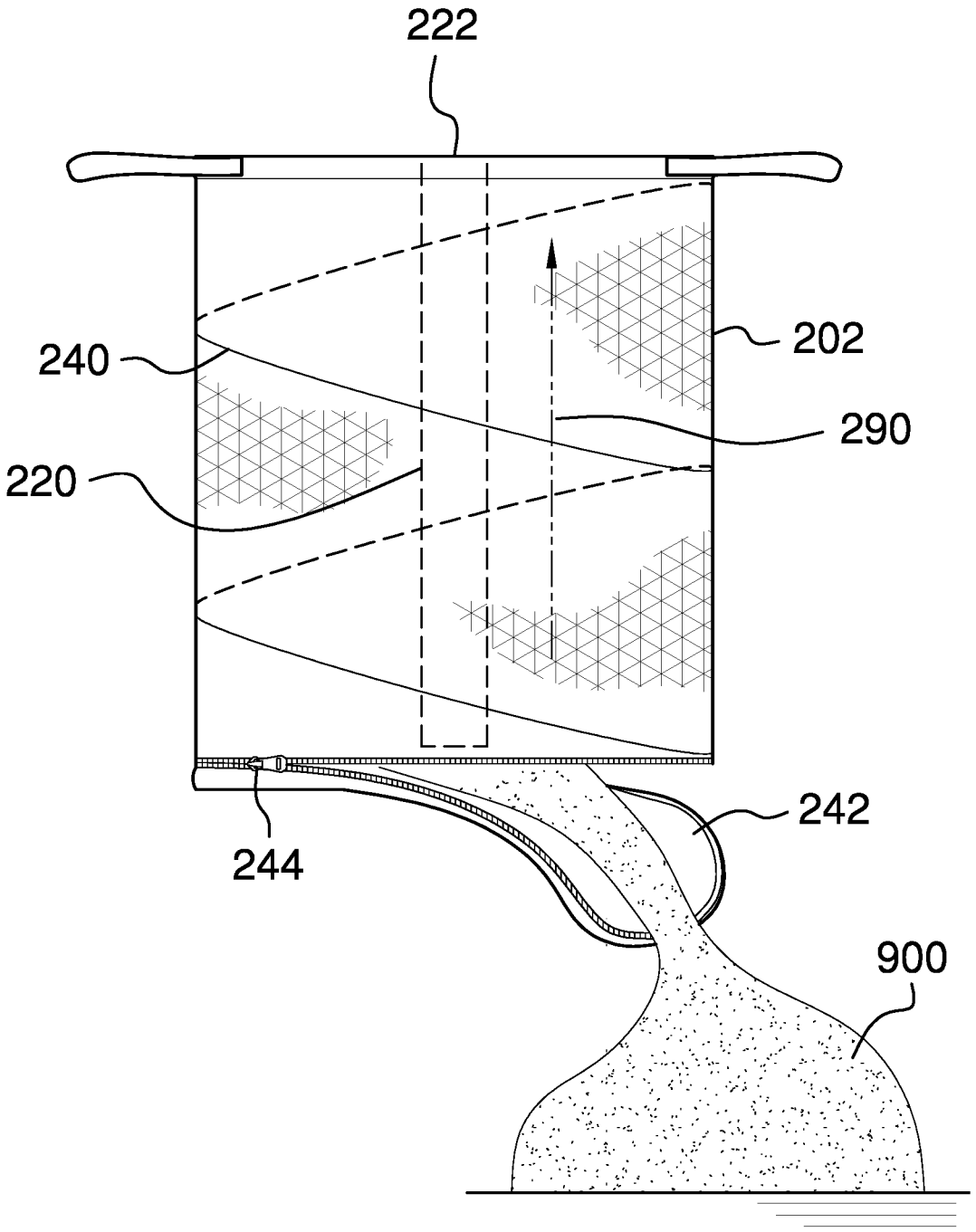
FIG. 3 is a detail view of an embodiment of the disclosure illustrating removal of the filler material via the detachable bottom panel.
Figure 4:
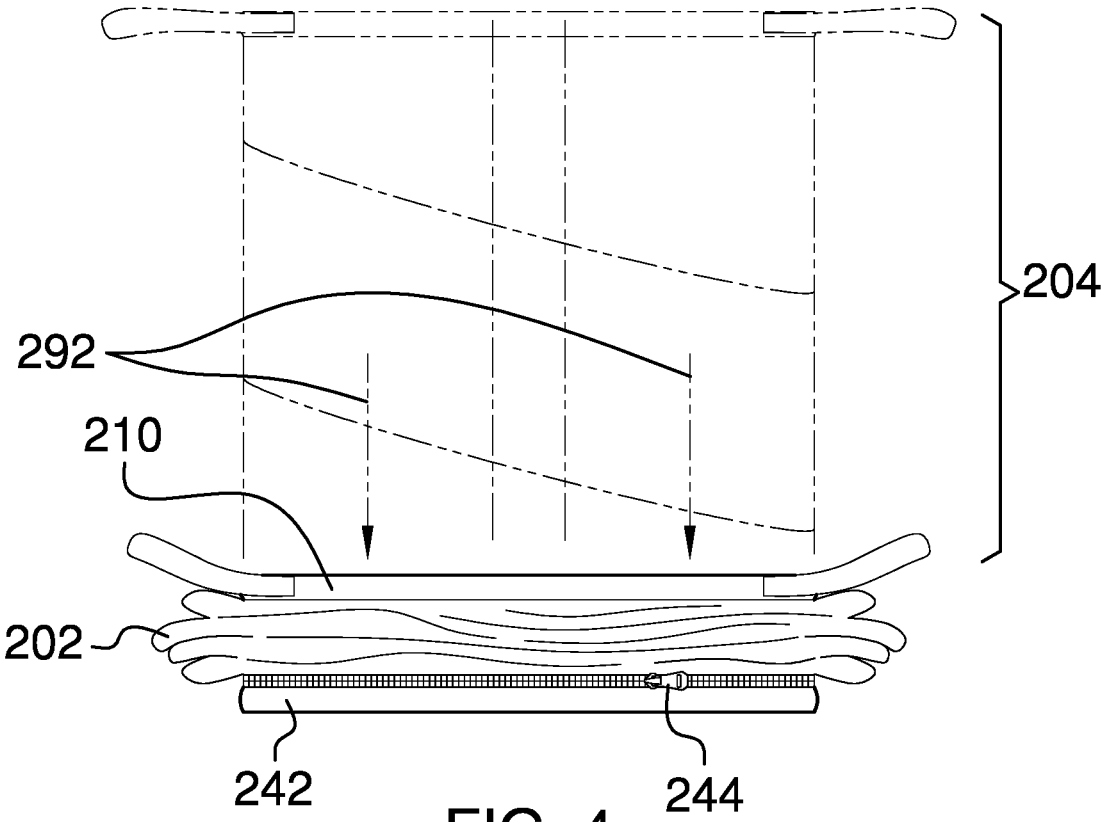
FIG. 4 is a detail view of an embodiment of the disclosure illustrating the base being collapsed by a collapsing force.
Figure 5:
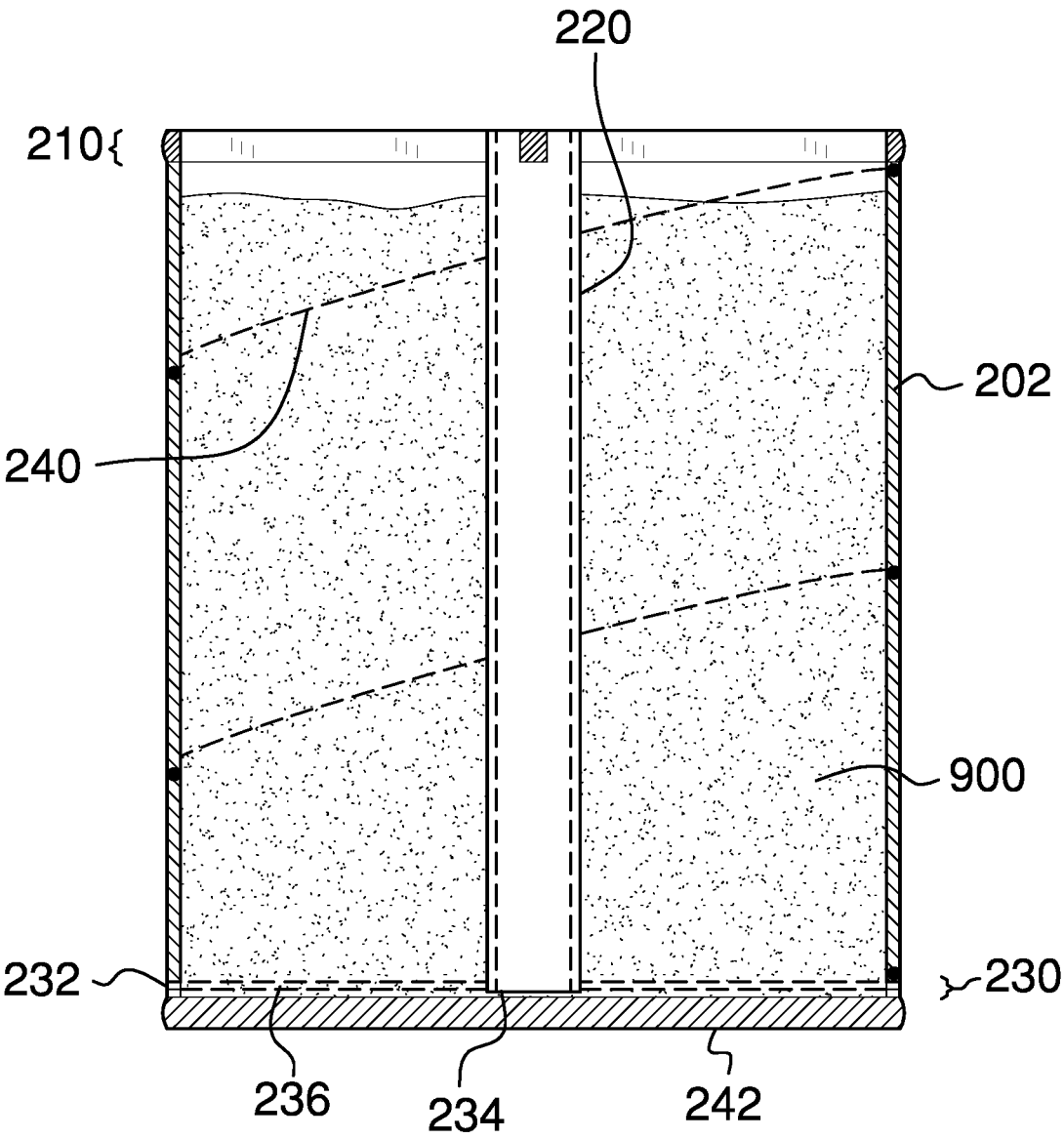
FIG. 5 is a cross-sectional view of an embodiment of the disclosure across 5-5 as shown in FIG. 2.

Detailed reference will now be made to a first potential embodiment of the disclosure, which is illustrated in FIGS. 1 through 5.

The sand-filled umbrella holder with tabletop 100 (hereinafter invention) comprises a base 200, a table top 250, and an umbrella 270. When deployed, the base 200 may be operable to hold the umbrella 270 in an upright position and may be operable to support the table top 250 above the ground. The base 200 may be deployed by filling the base 200 with a filler material 900 to give weight and form to the base 200. As non-limiting examples, the filler material 900 may comprise sand, dirt, or water. The base 200 may collapse when not deployed for easier transportation and storage. The umbrella 270 may provide shade when open for use. The umbrella 270 may close for easier transportation and storage when not in use.

The base 200 may comprise a side wall 202, a bottom panel 242, a coil spring 240, a top support 210, and a center sleeve 220. The base 200 may form a cylindrical pedestal for elevating the table top 250 when the base 200 is deployed. The bottom of the base 200 may rest upon the ground. The table top 250 may rest upon the top of the base 200.

The side wall 202 may be flexible material in the shape of a cylindrical tube 204. The cylindrical tube 204 may be vertically-oriented and hollow when the base 200 is deployed. The cylindrical tube 204 may collapse by gathering the side wall 202 vertically when the base 200 is not deployed. The top of the cylindrical tube 204 may be open such that the filler material 900 may be placed into the cylindrical tube 204. The bottom of the cylindrical tube 204 may be sealed using the bottom panel 242 to retain the filler material 900. The bottom panel 242 may be partially of fully detached from the side wall 202 using a bottom panel fastener 244 such that the filler material 900 may be removed from the base 200 through the bottom of the base 200. In some embodiments, the bottom panel fastener 244 may be a zipper.

The coil spring 240 may be a helical spring that is coupled to the side wall 202 such that the coil spring 240 applies an expanding force 290 to the side wall 202. Under the influence of the expanding force 290 of the coil spring 240, the side wall 202 may stand erect and form the cylindrical tube 204 in preparation for placement of the filler material 900 into the base 200. The coil spring 240 may be compressed by a collapsing force 292 to compress the side wall 202 once the filler material 900 has been removed.

The top support 210 may comprise a top rim 212, a top centering collar 214, and a plurality of top spacers 216. The top support 210 may be a horizontally-oriented armature located at the top of the side wall 202. The top support 210 may support the top of the side wall 202 and an umbrella pole 272.

The top rim 212 may be a circular armature that is coupled to the top of the side wall 202 such that the side wall 202 is held open to form the base 200. The top centering collar 214 may be a horizontally-oriented, circular armature located at the center of the top support 210. The top centering collar 214 may be held in place by the plurality of top spacers 216. An individual top spacer selected from the plurality of top spacers 216 may couple to the top centering collar 214 at an inside end of the individual top spacer and may couple to the top rim 212 at an outside end of the individual top spacer. The top centering collar 214 may comprise a hollow center such that the umbrella pole 272 may pass through the top centering collar 214.

The center sleeve 220 may be a vertically-oriented tube of flexible material that is located at the center of the base 200. The top of the center sleeve 220 may be open to form a sleeve aperture 222. The top of the center sleeve 220 may be coupled to the top centering collar 214. The umbrella pole 272 may slide through the center sleeve 220 to the bottom of the base 200 when the umbrella pole 272 is inserted into the top centering collar 214.

In some embodiments, the base 200 may comprise a bottom support 230. The bottom support 230 may be a horizontally-oriented armature located at the bottom of the side wall 202. The bottom support 230 may support the bottom of the side wall 202. The bottom support 230 may comprise a bottom rim 232. The bottom rim 232 may be a circular armature that is coupled to the bottom of the side wall 202 such that the side wall 202 is held open.

In some embodiments, the bottom support 230 may comprise a bottom centering collar 234. The bottom centering collar 234 may be a horizontally-oriented, circular armature located at the center of the bottom support 230. The bottom centering collar 234 may be held in place by a plurality of bottom spacers 236. An individual bottom spacer selected from the plurality of bottom spacers 236 may couple to the bottom centering collar 234 at an inside end of the individual bottom spacer and may couple to the bottom rim 232 at an outside end of the individual bottom spacer. In some embodiments, the bottom of the center sleeve 220 may be coupled to the bottom centering collar 234.

The table top 250 may be a horizontally-oriented surface upon which items may be placed. As non-limiting examples, the items that may be placed upon the table top 250 may comprise beverages, sunglasses, containers of sunscreen, cellphones, and keys. The table top 250 may comprise an umbrella aperture 252 at the center of the table top 250. The table top 250 may be placed on top of the base 200 such that the umbrella pole 272 may pass through the umbrella aperture 252 and into the top centering collar 214 and the center sleeve 220. The base 200 may elevate the table top 250 and the umbrella pole 272 may prevent the table top 250 from sliding off of the base 200.

The table top 250 may comprise two or more table top segments 254 that are hingedly coupled via one or more hinges 256. The two or more table top segments 254 may be unfolded to be coplanar in order to form the table top 250. The two or more table top segments 254 may be folded at the one or more hinges 256 such that the two or more table top segments 254 are positioned parallel to each other in order to reduce the size of the table top 250 for transportation and storage. In some embodiments, the two or more table top segments 254 may comprise a first table top segment 260 and a second table top segment 262. The first table top segment 260 and the second table top segment 262 may each be a semicircular half of the table top 250 and may each comprise one half of the umbrella aperture 252. When the first table top segment 260 and the second table top segment 262 are unfolded to a coplanar configuration, the table top 250 with the umbrella aperture 252 at the center may be formed.

In some embodiments, the one or more hinges 256 may be living hinges.

The umbrella 270 may comprise the umbrella pole 272, a canopy 274, a plurality of ribs 276, and a finial 278. The umbrella 270 may provide shade by obstructing a line-of-sight to the sun. The umbrella pole 272 may be a vertical armature that extends from the bottom of the umbrella 270 to the finial 278 at the top of the umbrella 270. The plurality of ribs 276 may be pivotably coupled to the finial 278. The plurality of ribs 276 may extend radially away from the finial 278 when the umbrella 270 is open and may be position parallel to the umbrella pole 272 when the umbrella 270 is closed. The canopy 274 may be coupled to the plurality of ribs 276 such that the canopy 274 is stretched to provide shade when the umbrella 270 is open and collapses against the umbrella pole 272 when the umbrella 270 is closed In some embodiments, the invention 100 may comprise a tool 280 for moving the filler material 900. As non-limiting examples, the tool 280 may be a small shovel or scoop. The tool 280 may be operable to move the filler material 900 into the base 200 to fill the base 200.

In use, a user may fill the base 200 with the filler material 900 to give the base 200 weight and shape. The table top 250 may be unfolded and placed on top of the base 200. The umbrella pole 272 may be placed through the umbrella aperture 252 in the table top 250 and may pass through the top centering collar 214 and the center sleeve 220 such that the base 200 may hold the umbrella 270 upright. When no longer needed, the umbrella 270 may be removed from the base 200 and collapsed for storage. The filler material 900 may be removed from the base 200 by unfastening the bottom panel fastener 244 and lifting the side wall 202 such that the filler material 900 may flow out of the bottom of the base 200.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" may refer to top and "lower" may refer to the bottom. As a non-limiting example, the upper end of a vertical shaft is the top end of the vertical shaft.

As used in this disclosure, an "aperture" may be an opening in a surface. Aperture may be synonymous with hole, slit, crack, gap, slot, or opening.

As used in this disclosure, a "canopy" may be a cover, usually made of fabric that is placed above an area and creates a protected area within which people or objects are protected from the environment.

As used herein, the words "couple", "couples", "coupled" or "coupling", may refer to connecting, either directly or indirectly, and does not necessarily imply a mechanical connection.

As used in this disclosure, a "fastener" may be a device that is used to join or affix two objects. Fasteners may generally comprise a first element which is attached to the first object and a second element which is attached to the second object such that the first element and the second element join to affix the first object and the second object. Common fasteners may include, but are not limited to, hooks, zippers, snaps, clips, ties, buttons, buckles, quick release buckles, or hook and loop fasteners.

As used herein, "filling", or "refilling", refers to the act of placing a first item into a second item whether the quantity of the first item fills the second item or not. As non-limiting examples, the first item may be a liquid, such as water or gasoline, or a granulated solid, such as sand or coffee beans. As non-limiting examples, the second item may be a bin, a bottle, a tank, or another type of container.

As used herein, a "finial" may be an ornamental termination for a rod, screw, staff, shank, post, peak, spire, pinnacle, or gable. A finial may be purely decorative or may be functional. As a non-limiting example, a finial may provide waterproofing or a housing for another object. Non-limiting examples of places where finials are used include curtain rods, lamp shades, walking canes, building roofs, furniture, fence posts, flag poles, umbrellas, and staircase newel posts.

As used in this disclosure, "flexible" may refer to an object or material which will deform when a force is applied to it, which will not return to its original shape when the deforming force is removed, and which may not retain the deformed shape caused by the deforming force.

Unless noted otherwise, "ground" may refer to any surface which may support items and individuals. As non-limiting examples, ground may refer to an earthen surface whether covered by vegetation or not, a floor, a tarmac, a driveway, a road, a deck, bedrock, or a stage. The phrase "from the ground" may refer to performing an activity while standing on such a surface as opposed to climbing a ladder.

As used in this disclosure, a "helix" may be the three dimensional structure that is formed by a wire that is wound uniformly around the surface of a cylinder or a cone. If the wire is wrapped around a cylinder the helix is called a cylindrical helix. If the wire is wrapped around a cone, the helix is called a conical helix. A synonym for conical helix would be a volute. "Helical" may be an adjective which indicates that an object is shaped like a helix.

As used in this disclosure, a "hinge" may be a device that permits the turning, rotating, or pivoting of a first object relative to a second object.

As used in this disclosure, "horizontal" may be a directional term that refers to a direction that is perpendicular to the local force of gravity. Unless specifically noted in this disclosure, the horizontal direction is always perpendicular to the vertical direction.

As used in this disclosure, a "pedestal" may be an intermediary load bearing structure that is placed between a supporting surface and an object, structure, or load.

As used in this disclosure, a "rim" may be an outer edge or border that follows along the perimeter of an object.

As used in this disclosure, a "sleeve" may be a tube like covering that is placed over or around a rod, shaft, cable, or other cylindrical object.

As used in this disclosure, a "spring" may be a device that is used to store mechanical energy. This mechanical energy will often be stored by deforming an elastomeric material that is used to make the device, by the application of a torque to a rigid structure, or by a combination thereof. In some embodiments, the rigid structure to which torque is applied may be composed of metal or plastic.

As used in this disclosure, an "umbrella" may be a device used for protection against the weather, including rain, sun, and snow, comprising a canopy made of a textile or sheeting that is mounted on a folding metal frame and is supported by a central rod.

As used in this disclosure, "vertical" may refer to a direction that is parallel to the local force of gravity. Unless specifically noted in this disclosure, the vertical direction is always perpendicular to horizontal.

As used in this disclosure, a "zipper" may be a fastening device comprising two flexible strips with interlocking components that are opened and closed by pulling a slide along the two flexible strips.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A sand-filled umbrella holder with tabletop comprising: a base, a table top, and an umbrella;

wherein when deployed, the base is operable to hold the umbrella in an upright position and is operable to support the table top above the ground;

wherein the base is deployed by filling the base with a filler material to give weight and form to the base;

wherein the base collapses when not deployed;

wherein the umbrella provides shade when open for use;

wherein the umbrella closes when not in use;

wherein the base comprises a side wall, a bottom panel, a coil spring, a top support, and a center sleeve;

wherein the base forms a cylindrical pedestal for elevating the table top when the base is deployed;

wherein the bottom of the base rests upon the ground;

wherein the table top rests upon the top of the base.

2. The sand-filled umbrella holder with tabletop according to claim 1 wherein the side wall is flexible material in the shape of a cylindrical tube;

wherein the cylindrical tube is vertically-oriented and hollow when the base is deployed;

wherein the cylindrical tube collapses by gathering the side wall vertically when the base is not deployed;

wherein the top of the cylindrical tube is open such that the filler material is placed into the cylindrical tube;

wherein the bottom of the cylindrical tube is sealed using the bottom panel to retain the filler material;

wherein the bottom panel is partially or fully detached from the side wall using a bottom panel fastener such that the filler material is removed from the base through the bottom of the base.

3. The sand-filled umbrella holder with tabletop according to claim 2 wherein the bottom panel fastener is a zipper.

4. The sand-filled umbrella holder with tabletop according to claim 2 wherein the coil spring is a helical spring that is coupled to the side wall such that the coil spring applies an expanding force to the side wall;

wherein under the influence of the expanding force of the coil spring, the side wall stands erect and form the cylindrical tube in preparation for placement of the filler material into the base;

wherein the coil spring is compressed by a collapsing force to compress the side wall once the filler material has been removed.

5. The sand-filled umbrella holder with tabletop according to claim 4 wherein the top support comprises a top rim, a top centering collar, and a plurality of top spacers;

wherein the top support is a horizontally-oriented armature located at the top of the side wall;

wherein the top support supports the top of the side wall and an umbrella pole.

6. The sand-filled umbrella holder with tabletop according to claim 5 wherein the top rim is a circular armature that is coupled to the top of the side wall such that the side wall is held open to form the base.

7. The sand-filled umbrella holder with tabletop according to claim 6 wherein the top centering collar is a horizontally-oriented, circular armature located at the center of the top support;

wherein the top centering collar is held in place by the plurality of top spacers;

wherein an individual top spacer selected from the plurality of top spacers couples to the top centering collar at an inside end of the individual top spacer and couples to the top rim at an outside end of the individual top spacer.

8. The sand-filled umbrella holder with tabletop according to claim 7 wherein the top centering collar comprises a hollow center such that the umbrella pole passes through the top centering collar.

9. The sand-filled umbrella holder with tabletop according to claim 8 wherein the center sleeve is a vertically-oriented tube of flexible material that is located at the center of the base;

wherein the top of the center sleeve is open to form a sleeve aperture;

wherein the top of the center sleeve is coupled to the top centering collar.

10. The sand-filled umbrella holder with tabletop according to claim 9 wherein the umbrella pole slides through the center sleeve to the bottom of the base when the umbrella pole is inserted into the top centering collar.

11. The sand-filled umbrella holder with tabletop according to claim 10 wherein the base comprises a bottom support;

wherein the bottom support is a horizontally-oriented armature located at the bottom of the side wall;

wherein the bottom support supports the bottom of the side wall;

wherein the bottom support comprises a bottom rim;

wherein the bottom rim is a circular armature that is coupled to the bottom of the side wall such that the side wall is held open.

12. The sand-filled umbrella holder with tabletop according to claim 11 wherein the bottom support comprises a bottom centering collar;

wherein the bottom centering collar is a horizontally-oriented, circular armature located at the center of the bottom support;

wherein the bottom centering collar is held in place by a plurality of bottom spacers;

wherein an individual bottom spacer selected from the plurality of bottom spacers couples to the bottom centering collar at an inside end of the individual bottom spacer and couples to the bottom rim at an outside end of the individual bottom spacer.

13. The sand-filled umbrella holder with tabletop according to claim 12 wherein the bottom of the center sleeve is coupled to the bottom centering collar.

14. The sand-filled umbrella holder with tabletop according to claim 10 wherein the table top is a horizontally-oriented surface upon which one or more items are placed;

wherein the table top comprises an umbrella aperture at the center of the table top;

wherein the table top is placed on top of the base such that the umbrella pole passes through the umbrella aperture and into the top centering collar and the center sleeve;

wherein the base elevates the table top and the umbrella pole prevents the table top from sliding off of the base.

15. The sand-filled umbrella holder with tabletop according to claim 14 wherein the table top comprises two or more table top segments that are hingedly coupled via one or more hinges;

wherein the two or more table top segments are unfolded to be coplanar in order to form the table top;

wherein the two or more table top segments are folded at the one or more hinges such that the two or more table top segments are positioned parallel to each other in order to reduce the size of the table top for transportation and storage.

16. The sand-filled umbrella holder with tabletop according to claim 15 wherein the two or more table top segments comprise a first table top segment and a second table top segment;

wherein the first table top segment and the second table top segment are each a semicircular half of the table top and each comprise one half of the umbrella aperture;

wherein when the first table top segment and the second table top segment are unfolded to a coplanar configuration, the table top with the umbrella aperture at the center is formed.

17. The sand-filled umbrella holder with tabletop according to claim 16 wherein the one or more hinges are living hinges.

18. The sand-filled umbrella holder with tabletop according to claim 16 wherein the umbrella comprises the umbrella pole, a canopy, a plurality of ribs, and a finial;

wherein the umbrella provides shade by obstructing a line-of-sight to the sun;

wherein the umbrella pole is a vertical armature that extends from the bottom of the umbrella to the finial at the top of the umbrella;

wherein the plurality of ribs are pivotably coupled to the finial;

wherein the plurality of ribs extend radially away from the finial when the umbrella is open and are position parallel to the umbrella pole when the umbrella is closed;

wherein the canopy is coupled to the plurality of ribs such that the canopy is stretched to provide shade when the umbrella is open and collapses against the umbrella pole when the umbrella is closed.

19. The sand-filled umbrella holder with tabletop according to claim 18 wherein the sand-filled umbrella holder with tabletop comprises a tool for moving the filler material;

wherein the tool is operable to move the filler material into the base to fill the base.

* * * * *